United States Patent [19]

Hendriks

[11] Patent Number: 4,576,423

[45] Date of Patent: Mar. 18, 1986

[54] CABINET DRAWERS SECURITY LOCKING DEVICE

[76] Inventor: John G. Hendriks, 608 Martha, Decatur, Ala. 35601

[21] Appl. No.: 657,550

[22] Filed: Oct. 4, 1984

[51] Int. Cl.[4] ..... E05B 65/46

[52] U.S. Cl. ..... 312/216; 70/81; 211/4; 292/253 R; 312/348

[58] Field of Search ..... 70/81, 78, 79, 80, 84; 312/216, 217, 333, 348, 107.5, 215; 211/4, 129; 292/259 R

[56] References Cited

U.S. PATENT DOCUMENTS

| | | | |
|---|---|---|---|
| 1,292,550 | 1/1919 | Wheary | 312/216 |
| 2,563,718 | 8/1951 | Gifford | 312/216 |
| 2,987,358 | 6/1961 | Roberts | 312/216 |
| 3,856,373 | 12/1974 | Tucich | 312/216 |
| 3,902,603 | 9/1975 | Wilson | 312/216 |
| 4,465,329 | 8/1984 | Haas et al. | 312/216 |

FOREIGN PATENT DOCUMENTS

| | | | |
|---|---|---|---|
| 560445 | 10/1923 | France | 312/216 |
| 754743 | 8/1956 | United Kingdom | 312/216 |

*Primary Examiner*—Kenneth J. Dorner
*Assistant Examiner*—Vinh Luong
*Attorney, Agent, or Firm*—Anthony T. Lane; Robert P. Gibson; Harold W. Hilton

[57] ABSTRACT

A locking device for retaining a plurality of drawers in secured relation in a cabinet even while the cabinet is being transported and subjected to vibrations. The device includes a rod carried in snug fitting relation in openings provided in upper and lower support brackets secured, respectively, to upper and lower surfaces of the cabinet. The rod is movable into and out of engagement with the drawers while remaining in the support bracket.

1 Claim, 5 Drawing Figures

CABINET DRAWERS SECURITY LOCKING DEVICE

DEDICATORY CLAUSE

The invention described herein may be manufactured, used, and licensed by or for the Government for governmental purposes without the payment to me of any royalties thereon.

BACKGROUND OF THE INVENTION

There are many vans which have storage cabinets therein. Some such vans may be RV's or military vans which accompany missiles in the field. The cabinets in the RV's may store supplies, etc., while the storage cabinets of the military vans are generally used to store missile spare parts. Cabinets are manufactured with built in latches for retaining the doors or drawers thereof in closed position; however, during movement of the vehicles the vibrations may release the doors or drawers from the closed position.

It is therefore an object of the present invention to provide a self-storing locking device for storage cabinets.

It is a further object of the present invention to provide such a locking device which will retain the doors or drawers of the cabinets in secured relation while the van is moved over terrain in which it is subjected to vibrations or gravitational forces which are substantial but less than severe.

SUMMARY OF THE INVENTION

A locking device for retaining a plurality of drawers in secured relation in a cabinet even while the cabinet is subjected to vibration. The device is a rod having two different diameters. A pair of support brackets is provided on the upper and lower surfaces of the cabinets. The upper bracket is provided with a pair of joined openings therein and the lower bracket is provided with a pair of spaced smaller openings. The rod is provided with an upper diameter larger than the diameter of the lower portion of the rod so that the rod may be tilted and inserted in the bracket openings in vans having a low overhead. The rod is retained in the brackets and movable from one set of openings therein to the second set of openings.

DESCRIPTION OF THE PREFERRED EMBODIMENT

Figure 1:
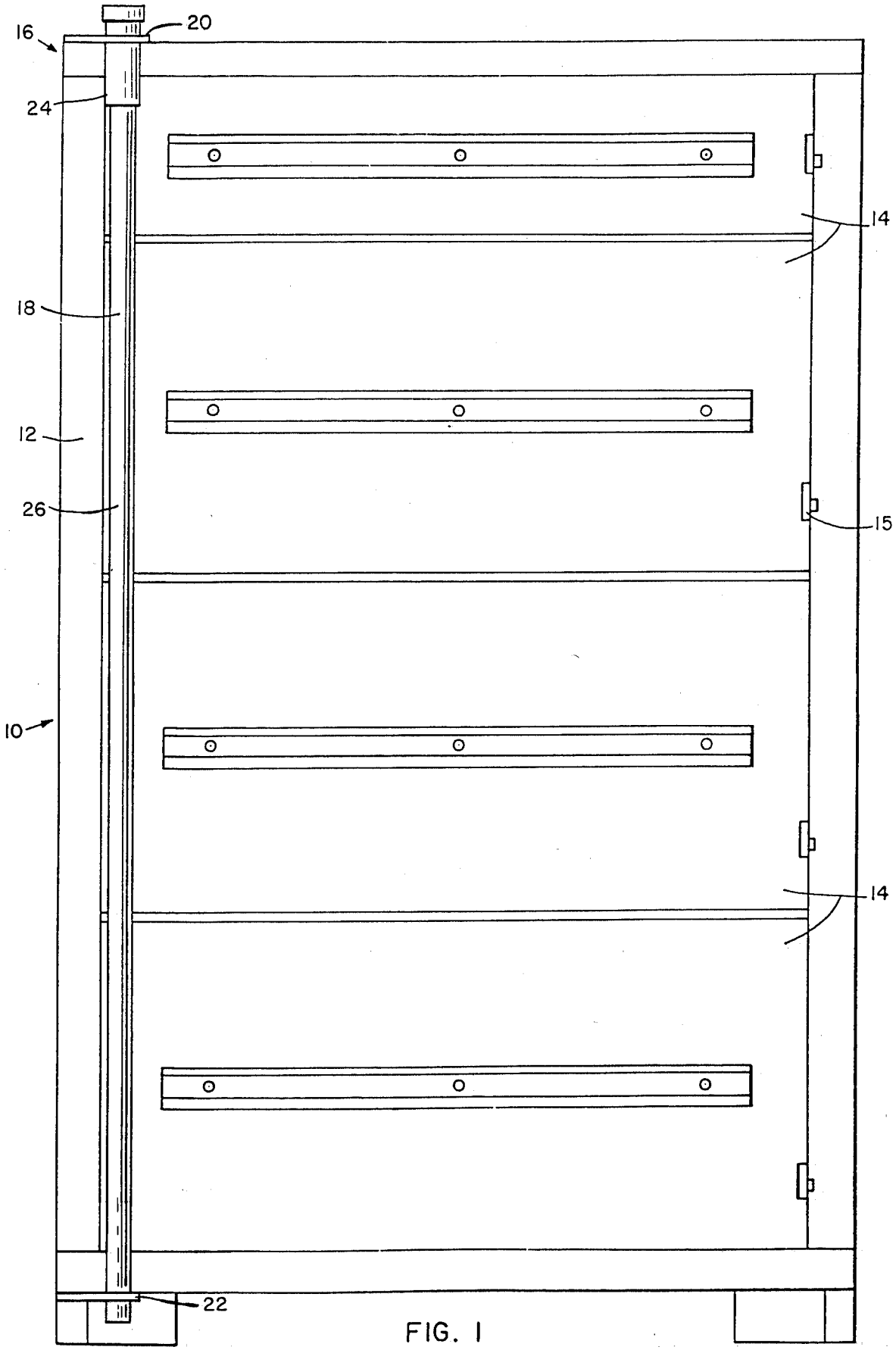
FIG. 1 is an elevational view of a cabinet having the locking device of the present invention in position for retaining the cabinet drawers thereof in secured relation.

As seen in FIG. 1 a cabinet 10 includes a frame 12 having a plurality of drawers 14 slidably carried therein. Typically the drawers are retained in the frame by latching devices illustrated at 15. However, such devices have proven incapable of securing the drawers in the frame when the cabinets are subjected to vibrations. A second locking mechanism 16, therefore, is provided for releasably securing the drawers 14 in frame 12 under these conditions.

Locking mechanism 16 includes a rod 18 supported on cabinet 10 by upper and lower brackets or support members 20 and 22, respectively. The support members 20 and 22 may be secured to the cabinet by bolts or by welding.

Figure 2:
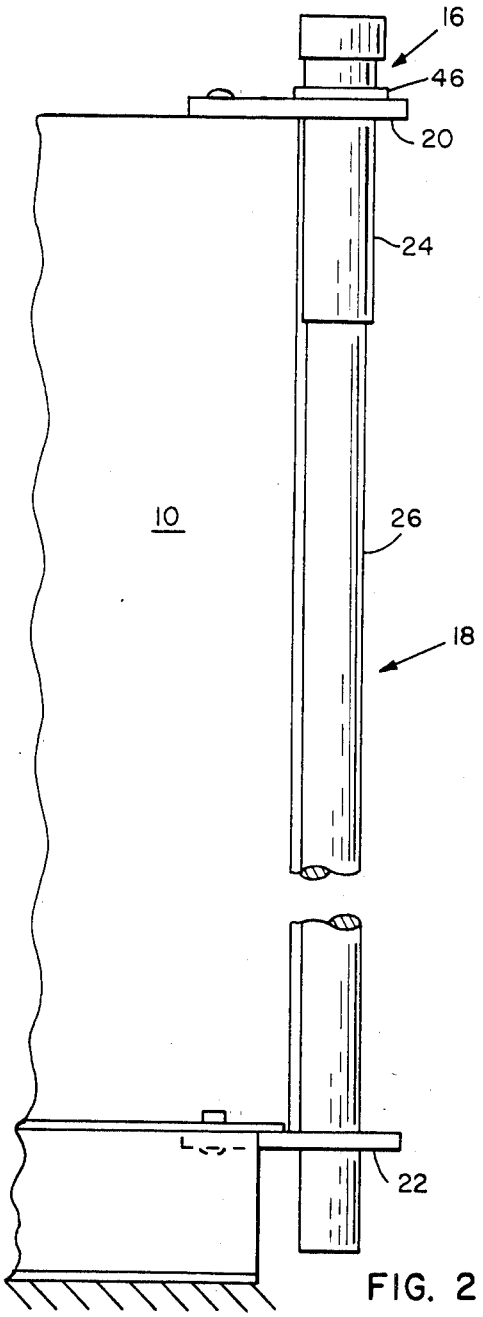
FIG. 2 is a side elevational view showing the rod in secured position.

FIG. 2 is a side elevational view of the cabinet and rod assembly. As more clearly illustrated in FIG. 2 the rod is provided with upper and lower sections 24 and 26, respectively. Upper section 24 is of a larger diameter than lower section 26 and the upper end protrudes through upper support member 20 while the lower end protrudes through lower support member 22.

Figure 3:
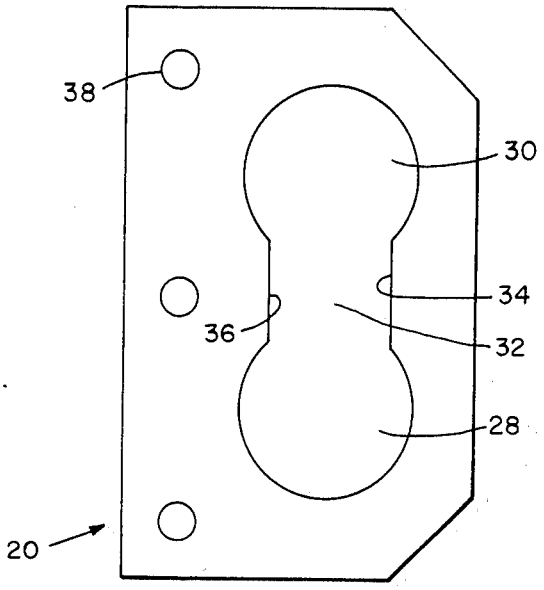
FIG. 3 is a plan view of the upper bracket of the locking device of the present invention.

As seen in FIG. 3 the upper support member includes a pair of substantially semi-circular joined openings 28 and 30. An opening or slot 32 is defined by a pair of spaced flat surfaces 34 and 36 which join openings 28 and 30. Slot 32 is smaller than the diameter of openings 28 and 30 and larger than the diameter of lower section 26 of the rod. A plurality of additional small openings 38 is provided for bolting support member 20 to the cabinet.

Figure 4:
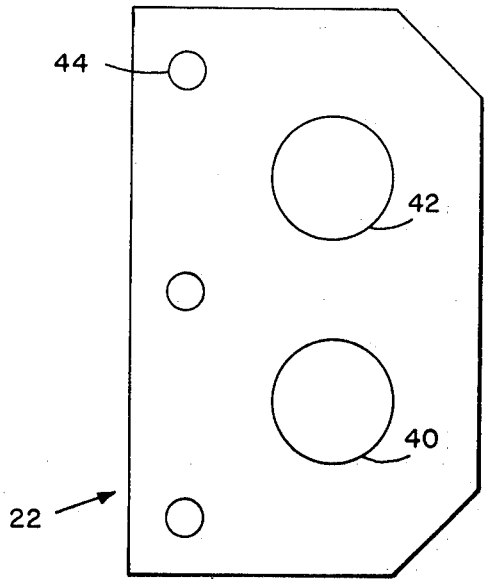
FIG. 4 is a plan view of the lower bracket of the locking device of the present invention.

As seen in FIG. 4, lower support member 22 includes a pair of spaced openings 40 and 42. Openings 40 and 42 are of smaller diameter than openings 28 and 30 of upper support bracket 20. A pluralty of additional small openings 44 is provided for bolting support member 22 to the bottom side of the cabinet.

Figure 5:
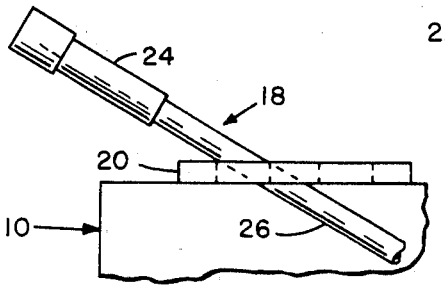
FIG. 5 is a diagrammatic illustration of the manner in which the rod is inserted in the brackets in a van having a low ceiling.

FIG. 5 is an illustration of the manner in which the rod may be inserted in the brackets in a van having a low ceiling. Rod 18 is titled as shown for insertion into the upper bracket 20. Since the diameter of the lower portion of the rod is smaller than the openings 28 and 30 and connecting slot 32 of upper bracket 20, the rod may be inserted at a substantially steep angle. The rod is then slid through bracket 20 until the upper larger diameter portion 24 cannot be inserted through slot 32 since it is of a larger diameter than slot 32. The rod is then vertically aligned with an opening of the lower bracket and the lower end inserted therein. To retain the rod in stored position (with the drawers unsecured) the rod is positioned in openings 28 and 40 of brackets 20 and 22, respectively. To position the rod for securing the drawers in locked position it is merely raised so that the lower surface 48 of the larger diameter portion is clear of bracket 20 and since the diameter of the lower portion of the rod is smaller than slot 32, the rod may be slid through the slot and into opening 30. The rod is then aligned with opening 42 of bracket 22 and inserted therein. A retainer ring 46 may be used to hold the rod in the position shown in FIG. 2.

The upper portion 24 of rod 18 is provided with a diameter just slightly smaller than the diameter of openings 28 and 30 of bracket 20. The lower diameter of rod 18 is provided with a diameter which is just slightly smaller than openings 40 and 42 of bracket 22. Thus when the rod is in the openings there is a very tight fitting or snug relationship of the rod and the bracket. This feature retains the rod in the brackets even under substantial vibrations of G forces.

I claim:

1. A locking device for releasably securing a plurality of drawers in a cabinet, said locking device comprising:

a. a pair of upper and lower support brackets, said upper and lower support brackets respectively secured to upper and lower surfaces of said cabinet, said upper support bracket having a pair of semi-circular openings therein joined by a connecting slot having a width smaller than the diameters of said semi-circular openings, said lower bracket having a pair of spaced openings therein, said openings of said lower bracket having a smaller diameter than said semi-circular openings of said upper bracket; and, b. a rod slidably supported in said brackets, said rod disposed for engagement with said drawers for retention thereof in secured relation, said rod being positioned in a first of said semi-circular openings of said upper bracket and a first of said pair of spaced openings of said lower bracket for secured relation of said drawers and movable to a second of said semi-circular openings of said upper bracket and a second of said pair of spaced openings of said lower bracket for release of said drawers, said rod having an upper section provided with a diameter larger than the diameter of a lower section thereof, said lower section having a diameter smaller than said connecting slot of said upper bracket.

* * * * *